US005693372A

United States Patent [19]

Mistrater et al.

[11] Patent Number: 5,693,372

[45] Date of Patent: Dec. 2, 1997

[54] IMMERSION COATING PROCESS

[75] Inventors: Alan B. Mistrater, Rochester; Steven J. Grammatica, Penfield; Peter J. Valianatos, Rochester; Timothy J. Leenhouts, Fairport; April M. Mattox, Webster; Rachael A. Forgit, Rochester; John S. Chambers, Rochester; Roger T. Janezic, Rochester, all of N.Y.; Leslie B. Cummins, North Brunswick, N.J.; Richard C. Petralia, Rochester, N.Y.; Edward C. Williams, Palmyra, N.Y.; Mark S. Thomas, Williamson, N.Y.; John T. Dilko; John K. Williams, both of Fairport, N.Y.

[73] Assignee: Xerox Corporation, Stamford, Conn.

[21] Appl. No.: 608,829

[22] Filed: Feb. 29, 1996

[51] Int. Cl.[6] ..... B05D 1/18; B05D 1/24; B05D 3/02

[52] U.S. Cl. ..... 427/430.1; 427/435; 118/429

[58] Field of Search ..... 427/430.1, 431, 427/435; 118/429

[56] References Cited

U.S. PATENT DOCUMENTS

| | | | |
|---|---|---|---|
| 4,328,267 | 5/1982 | Matsuo et al. | 427/430.1 |
| 4,525,377 | 6/1985 | Nickel et al. | 427/430.1 |
| 4,620,996 | 11/1986 | Yashiki . | |
| 4,767,472 | 8/1988 | Vanneste . | |
| 4,964,366 | 10/1990 | Kurokawa et al. . | |
| 5,334,246 | 8/1994 | Pietrzykowski, Jr. et al. | 427/430.1 |
| 5,385,759 | 1/1995 | Crump et al. | 427/430.1 |
| 5,429,842 | 7/1995 | Appel et al. | 427/430.1 |
| 5,578,410 | 11/1996 | Petropoulos et al. | 427/430.1 |

*Primary Examiner*—Benjamin Utech
*Assistant Examiner*—Bret Chen

[57] ABSTRACT

A process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

24 Claims, 8 Drawing Sheets

IMMERSION COATING PROCESS

BACKGROUND OF THE INVENTION

This invention relates in general to a drum dip coating system and more specifically, to a process for dip coating drums to form coatings free of streaks.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic plates are usually multilayered drums or belts and comprise a substrate, an optional hole blocking layer, a charge generating layer, and a charge transport layer and, in some embodiments, an anti-curl backing layer.

Although excellent toner images may be obtained with multilayered photoreceptors, it has been found that as more advanced, higher speed electrophotographic copiers, duplicators and printers were developed, there is a greater demand on copy quality. The layers of the multilayered photoreceptor must meet precise tolerances in order to produce high quality copies. This places additional constraints on photoreceptor manufacturing techniques, and thus, on the manufacturing yield. One common technique employed to manufacture photoreceptors involves dip coating. Dip coating comprises dipping or immersing an uncoated or coated cylindrical substrate into a coating vessel containing a bath of liquid coating material. The dipped substrate is thereafter withdrawn and the liquid coating thereon is dried. The coating vessel has various shapes. The liquid coating material in the bath may be circulated upwardly in the coating vessel from an inlet at the bottom of the coating vessel and allowed to overflow from the bath. If desired, the coating may be continuously fed into the bottom of the coating vessel and allowed to continuously overflow from the coating vessel. The overflowing coating liquid may be collected in a vessel and recycled to the coating bath. One improvement to this method, for the purpose of preventing fluctuations of the liquid surface in the coating tank and making coating liquid preparation easy and further retaining uniformity of the coating liquid, it has been proposed to provide an additional tank separated from the coating bath and circulate the paint therebetween. According to this method, it is desirable that the coating material fed into the coating bath forms a uniform and smooth flow around a material to be coated. In other words, the coating material fed into the coating bath, which flows through a feeding inlet into the bath at a certain flow velocity, may agitate the coating liquid in the bath or ripple the liquid surface of the paint when flowing linearly through the feeding inlet into the coating bath, whereby unevenness of the coating may occur. For example, when uniformity of film thickness contributes largely to electrophotographic characteristics as in the case of a photosensitive layer of an electrophotographic photosensitive member, it is supremely important to remove the unevenness. When the surface of a hollow cylindrical drum having a lower open end and an upper closed end is dipped in the coating bath, any slight temperature difference between the coating bath and the ambient temperature frequently causes the air enclosed in the drum to expand or evaporation of the solvent in the coating liquid can increase the volume of the gas in the hollow drum thereby causing the formation of a bubble expelled from the lower end of the drum as the drum is withdrawn from the coating bath. The coating liquid will be displaced by the bubble as the bubble rises alongside the drum surface. This causes the coating on the surface of the drum to be uneven. In order to prevent this problem, it has been proposed to remove a part of the air enclosed in the coating object in the coating step by means of an air pipe connected to an air chamber made of a rubber. It is also known to dip coat an object in a coating device containing a bath of liquid coating material; a feeding inlet for feeding the coating material into the lower part of the coating bath; and a member for uniformizing the upward flow of the coating material from the lower part of the coating bath toward the upper part thereof, the member being located in the lower part of the coating bath and above the feeding inlet to intercept and direct the upward flow of the coating material along the entire wall periphery of the coating bath and provide a uniform and smooth flow of coating material around each portion of the object immersed in the coating bath. The foregoing techniques are described in U.S. Pat. No. 4,620,996, the entire disclosure thereof being incorporated herein by reference.

Typically, in a dip coating process, a coating solution or dispersion is applied to a drum. Dispersions usually comprise various components that are applied to a substrate to form a charge generation layer However, the dispersion may form a single layer photoreceptor instead of only a charge generating layer. These coating dispersions usually comprise two phases, such as solid pigment particles dispersed in a solution of a film forming binder dissolved in a solvent. This mixture forms a non-ideal dispersion. In an ideal coating mixture, viscosity remains constant regardless of the amount of shear applied to the coating mixture. In non-ideal coating compositions such as dispersions, viscosity tends to diminish rapidly with shear. Changes in viscosity affect the coating thickness of the deposited coating. It is has been found that during a dip coating operation, streaks can occur in the applied coating. These streaks can be seen by the naked eye and are undesirable from the cosmetic and functional points of view. For example, the streaks can cause print deletion in the final toner image on a printed copy, the deletions corresponding in shape to the streak defect on the photoreceptor. These streaks can occur in any of the layers applied to an electrophotographic imaging member but are particularly pronounced in a charge generating layer. The streaks may run the length of a drum or part of the length of a drum. The streaks appear as lighter streaks in a dark background or dark streaks in a lighter background. Moreover, these streaks may be branched. A typical streak typically has a width between about 0.2 micrometer and about 1 micrometer. Appearance of these streaks is often referred to as "marbling".

Another common defect in dip coated drums is a "grainy" appearance. This is apparently caused by flocculation of pigment particles in a binder. In some embodiments of this grainy appearance, the drum almost appears as if it were coated with sand particles. The grainy coating causes a grain pattern to form in the final print document. For example, large solid image areas in such a final print document can have a mottled appearance.

Dip coating of coated or uncoated substrates can also form coatings that are not uniform from one end of the drum to the other. Since the drums are coated with the drum axis maintained in a vertical position, the coatings on dip coated drums are often thicker at the bottom of the drum than at the top of the drum.

In the commercial production of electrophotographic imaging members, particularly in drum configuration, the complex nature of the manufacturing process renders unpredictable the quality of dip coated photoreceptor coatings from batch to batch and from month to month. Thus, for example, defect levels can increase in a new production run due to changes in the manufacturing environment such as the use of different size drum substrates. More specifically, a critical problem involving coating quality defects is encountered when large volume dip coating vessels normally used for large diameter drums are switched over to coat small diameter drums. This problem is manifested as "streaks" in the deposited coating. The characteristics of these streaks have been described above. These defects appear on the photoreceptor as wispy, lighter colored, pigment depleted areas (also referred to as "marbling"). Also, when a small drum substrate is dip coated in a coating vessel previously used to dip coat larger diameter drums, a larger quantity of costly coating material is required to fill the larger open space between the surface of the small diameter substrate and the walls of the large coating vessel. Further, the larger exposed top surface of the coating bath leads to a greater loss of solvent which, in turn, leads to undesirable changes in the concentration and coating characteristics of the coating bath. Conversion to smaller coating vessels requires many hours to remove and replace the coating vessels, requires long lead times for product delivery, takes up valuable clean room floor space, and requires costly additional sets of coating vessels for each drum size.

INFORMATION DISCLOSURE STATEMENT

U.S. Pat. No. 4,620,996 to Y. Yashiki, issued Nov. 4, 1986.—A coating device is disclosed for coating an object to be coated with a paint by dipping the object into a coating bath containing a paint, which comprises a member for uniformizing the flow of a paint gushing out from the lower part of the coating bath toward the upper part thereof, the member being provided in the coating bath at a lower part thereof. Coating was carried out with the coating device.

CROSS REFERENCE TO RELATED APPLICATIONS

This application is related to the following U.S. patent application

U.S. patent application Ser. No. 08/609,269, filed concurrently herewith in the name of Alan B. Mistrater et al., entitled "IMMERSION COATING APPARATUS—Apparatus is disclosed for dip coating comprising a drum having an outer surface to be coated, an upper end and a lower end, at least one coating vessel having a bottom, an open top and a cylindrically shaped vertical interior wall having a diameter greater than the diameter of the drum, an inlet at the bottom of the vessel, the inlet adapted to feed flowing coating fluid into the vessel, a mandrel adapted to maintain the outer surface of the drum in a concentric relationship with the vertical interior wall of the cylindrical coating vessel while the drum is immersed in the flowing coating material, the outer surface of the drum being radially spaced from the vertical interior wall of the cylindrical coating vessel, and at least one flow regulating member adapted to maintain laminar flow motion of the coating material as the fluid passes between the outer surface of the drum and the vertical inner wall of the vessel.

Thus, dip coating techniques have serious flaws, particularly in the dip coating of charge generating layers containing pigment particles dispersed in a film forming binder. These defects can adversely affect print quality during imaging with electrophotographic copiers, duplicators and printers. Thus there is a need for a system that will produce higher quality reliable photoreceptors. There is a continuing need for an improved system for coating electrophotographic imaging members.

SUMMARY OF THE INVENTION

It is, therefore, an object of the present invention to provide an improved system for dip coating a cylindrical electrophotographic imaging member which overcomes the above-noted deficiencies.

It is another object of the present invention to provide an improved system for dip coating a cylindrical electrophotographic imaging member forming coatings free of streaks or marbelting.

It is yet another object of the present invention to provide an improved system for dip coating a cylindrical electrophotographic imaging member.

It is still another object of the present invention to provide an improved system for dip coating a cylindrical electrophotographic imaging member which is substantially free of sources of heat that could be introduced into a flowing liquid coating material.

It is another object of the present invention to provide an improved system for dip coating a cylindrical electrophotographic imaging member which is substantially free of sources of heat that could be introduced into a flowing liquid coating material.

It is yet another object of the present invention to provide an improved system for dip coating a cylindrical electrophotographic imaging member which is substantially free of sources of shear that could be introduced into a flowing liquid coating material.

It is still another object of the present invention to provide an improved system for dip coating a cylindrical electrophotographic imaging member which is substantially free of sources of stress that could be introduced into a flowing liquid coating material.

It is another object of the present invention to provide an improved system for dip coating a cylindrical electrophotographic imaging member which is substantially free of sources of strain that could be introduced into a flowing liquid coating material.

It is yet another object of the present invention to provide an improved system for dip coating a cylindrical electrophotographic imaging member which is substantially free of sources of compression that could be introduced into a flowing liquid coating material.

It is still another object of the present invention to provide an improved system for dip coating a cylindrical electrophotographic imaging member which is substantially free of sources of decompression that could be introduced into a flowing liquid coating material.

It is another object of the present invention to provide an improved system for dip coating a cylindrical electrophotographic imaging member which is substantially free of sources of sudden change of velocity that could be imparted to a flowing liquid coating material.

It is yet another object of the present invention to provide an improved system for dip coating a cylindrical electrophotographic imaging member which is substantially free of sources of sudden change of direction that could be imparted to a flowing liquid coating material.

It is still another object of the present invention to provide an improved system for dip coating a cylindrical electrophotographic imaging member which is substantially free of mechanical obstructions that could impede smooth flow of a liquid coating material.

It is another object of the present invention to provide an improved system for dip coating a cylindrical electrophotographic imaging member which isolates a flowing liquid coating material from sources of energy input.

It is yet another object of the present invention to provide an improved system for dip coating a cylindrical electrophotographic imaging member which isolates a flowing liquid coating material from loss of energy.

It is still another object of the present invention to provide an improved system for dip coating a cylindrical electrophotographic imaging member which can be rapidly converted to accommodate substrates of different diameters.

It is another object of the present invention to provide an improved system for dip coating a cylindrical electrophotographic imaging member which can utilize a single coating vessel for coating different sizes of drum substrates.

It is yet another object of the present invention to provide an improved system for dip coating a cylindrical electrophotographic imaging member which permits the use of low viscosity coating solutions.

It is still another object of the present invention to provide an improved system for dip coating a cylindrical electrophotographic imaging member which is less costly.

The foregoing objects and others are accomplished in accordance with this invention by providing a process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

BRIEF DESCRIPTION OF THE DRAWINGS

A more complete understanding of the present invention can be obtained by reference to the accompanying drawings wherein.

These figures merely schematically illustrate the invention and are not intended to exactly indicate relative size and dimensions of the device or components thereof.

DETAILED DESCRIPTION OF THE DRAWINGS

Figure 1:
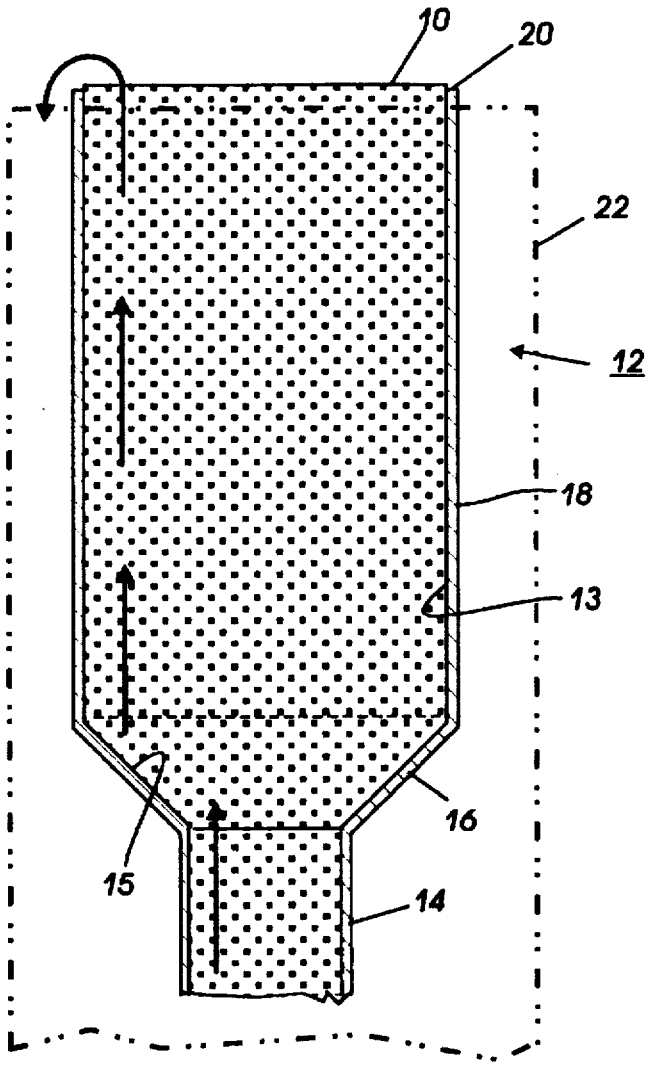
FIG. 1 is a schematic elevation view of a coating vessel.

Referring to FIG. 1, a liquid coating material 10 is shown in a coating vessel 12 having a feed inlet 14, inverted funnel shaped bottom 16, vertical cylindrical wall 18 and top edge 20. As indicated by the arrows, the coating material 10 enters coating vessel 12 through feed inlet 14, flows upwardly along an inverted funnel shaped wall 15 and upwardly parallel to vertical cylindrical wall 18, and overflows top edge 20 of vessel 12. The coating material that overflows top edge 20 is captured in a collecting tank 22 (partially shown by phantom lines).

Figure 2:
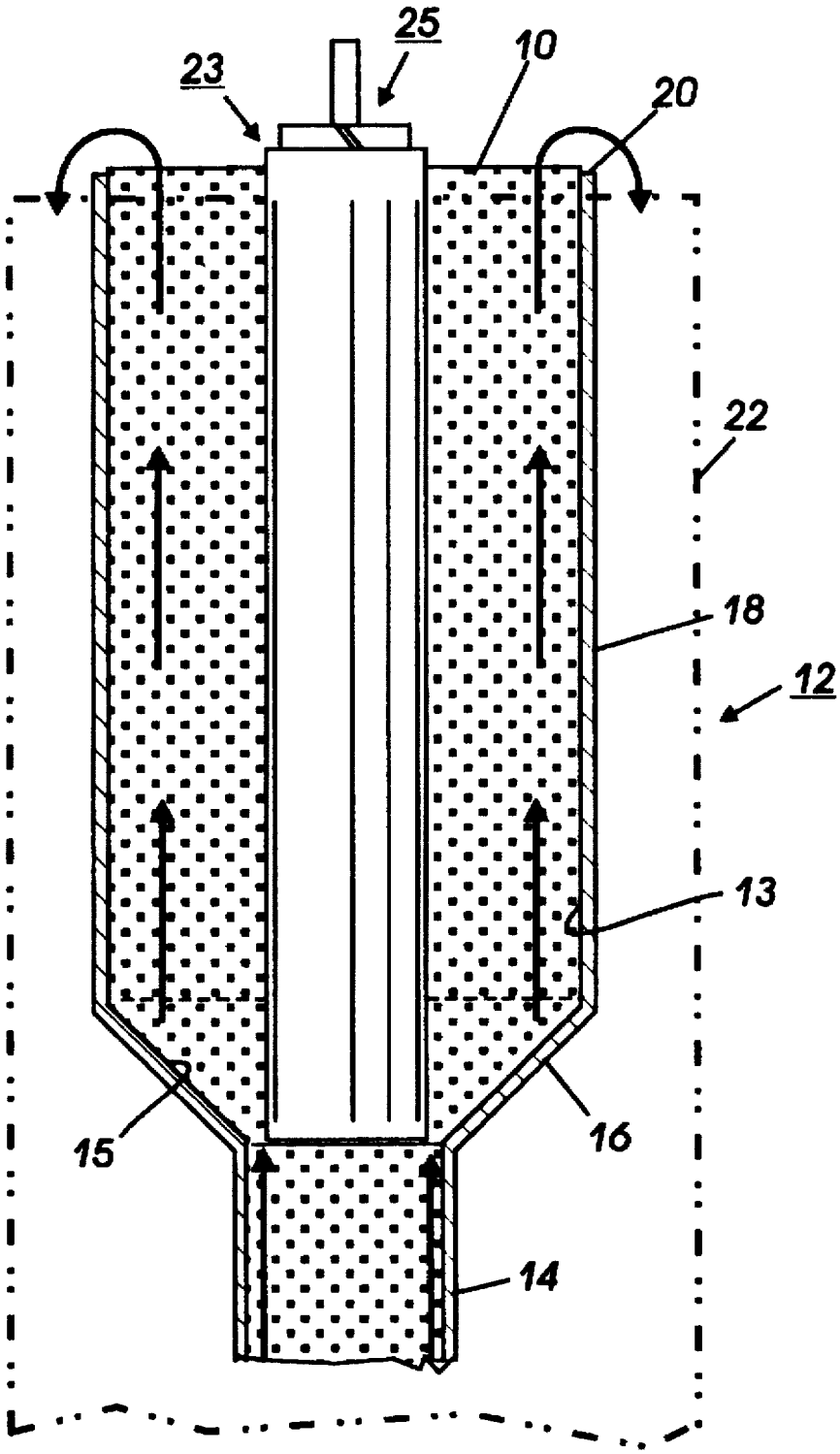
FIG. 2 is a schematic elevation view of the coating vessel shown in FIG. 1 containing a drum substrate which has a small outside diameter relative to the inside diameter of the coating vessel

Referring to FIG. 2, a hollow cylindrical drum substrate 23 is shown almost totally submerged in liquid coating material 10. Drum substrate 23 has an outer diameter that is relatively small compared to the inner diameter of vertical cylindrical wall 18 of coating vessel 12. In other words, the radial spacing between the outer surface of hollow cylindrical drum substrate 23 and the inner surface of vertical cylindrical wall 18 of the coating vessel 12 is very large. This can occur, for example, when a coating operation switches from the coating of large diameter drums to the coating of small diameter drums without changing the coating vessel. Drum substrate 23 is suspended from a conventional mandrel 25 which grips the interior surface of drum substrate 23. Mandrel 25 also functions as an air tight seal to trap air in the interior of drum substrate 23 when the drum substrate 23 is immersed in the bath of liquid coating material 10 contained in vessel 12. In dip coating, air trapped within the lower interior space of the hollow drum substrate 23 prevents the liquid coating material 10 from entering and depositing on the interior surface of the substrate 23 and the lower end of the mandrel 25. Usually, a narrow peripheral strip around the top of drum substrate 23 is not submerged in the bath of coating material 10 and remains uncoated. As is well known in the dip coating art the mandrel 25 is connected to conventional transport means which lowers the drum substrate 23 into the bath of liquid coating material 10 and thereafter raises drum substrate 23 from the bath of liquid coating material 10. An example of a drum transport device in a dip coating system is illustrated in U.S. Pat. No. 4,620,996, the disclosure thereof being incorporated herein in its entirety. Subsequent to withdrawal from the bath of liquid coating material 10 drum substrate 23 carries a thin coating of the material (not shown) from bath 10.

Figure 3:
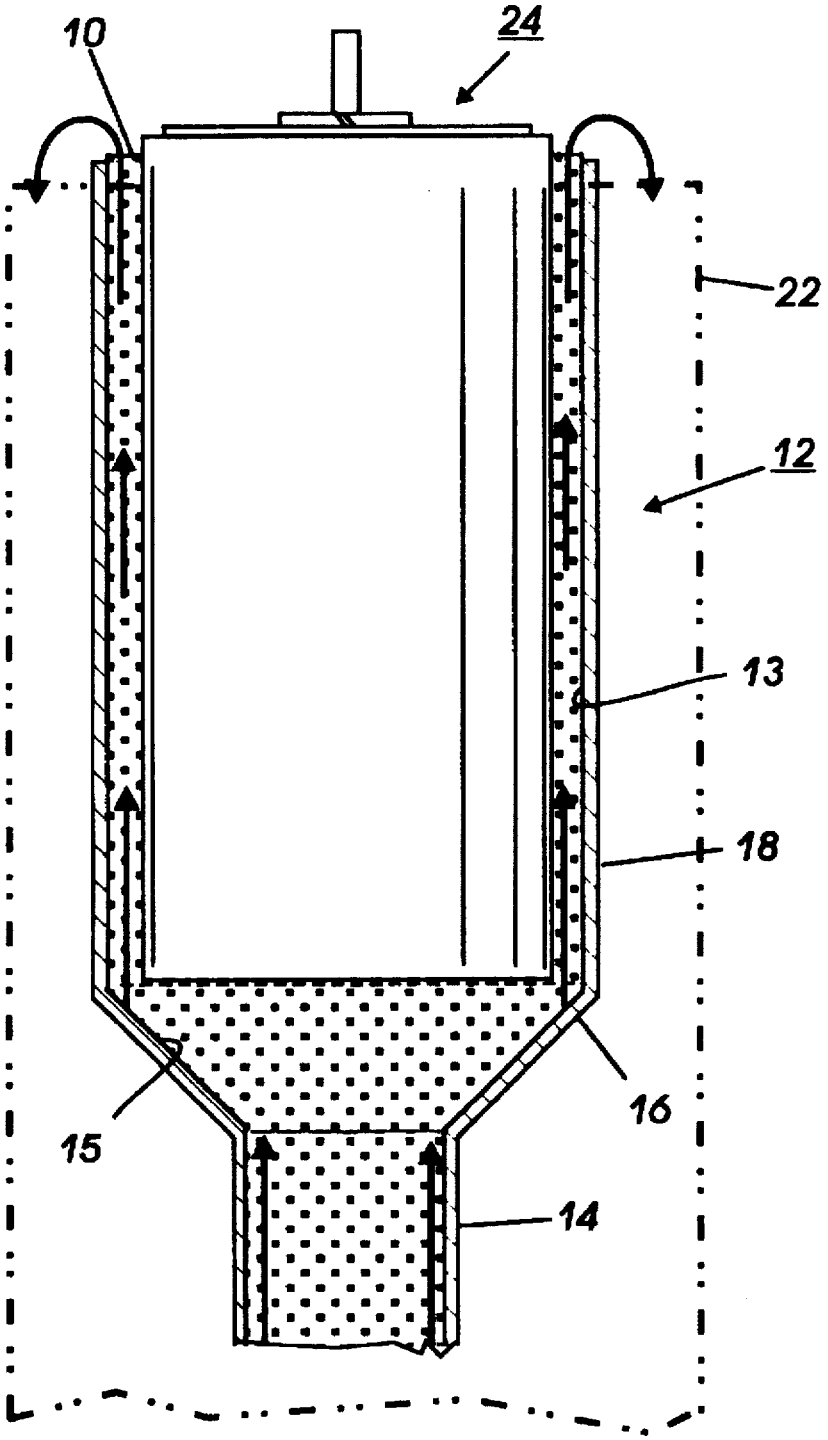
FIG. 3 is a schematic elevation view of the coating vessel shown in FIG. 1 containing a drum substrate which has an outside diameter that is only slightly smaller than the inside diameter of the coating vessel

In FIG. 3, a system of this invention is illustrated with hollow cylindrical drum substrate 24 almost totally submerged in liquid coating material 10. Hollow cylindrical drum substrate 24 has an outer diameter that is only slightly smaller than the inner diameter of the coating vessel 12. Thus, the radial spacing between the outer surface of hollow cylindrical drum substrate 24 and inner surface or wall of coating vessel 12 is extremely small. The drum substrate 24 should be substantially concentric with the inner surface of vertical cylindrical wall 18 of coating vessel 12 during the coating operation of this invention. It is critical that the radial spacing between the inner surface of vertical cylindrical wall 18 of coating vessel 12 and the outer surface of hollow cylindrical drum substrate 24 during the coating process is between about 2 millimeters and about 9 millimeters in order to adequately avoid streaks and graininess in the final coating. Preferably, the radial spacing is between about 4.5 millimeters and about 8.5 millimeters. Optimum coating layers are achieved with an axial spacing between about 5.5 millimeters and about 7.5 millimeters. Since the expression "radial spacing" refers to the spacing between the outer surface of cylindrical drum substrate 23 and the inner surface of vertical cylindrical wall 18 of coating vessel 12 on only one side of the drum along an imaginary radius line, the "diametric spacing" is twice the size of the "radial spacing" because the diametric spacing includes the spaces on opposite sides of cylindrical drum substrate 23 measured along an imaginary diameter line. Thus, the diametric spacing is between about 4 millimeters and about 18 millimeters. In Example 1 of U.S. Pat. No. 4,620,996, the radial spacing of the drum to the coating vessel wall is 1 centimeter or 10 millimeters. In Example 2 of U.S. Pat. No. 4,620,996, the radial spacing of the drum to the coating vessel wall is 10 millimeters. These radial spacings are about 11 percent greater than the maximum radial spacing of 9 millimeters used in the coating system of this invention.

Figure 4:
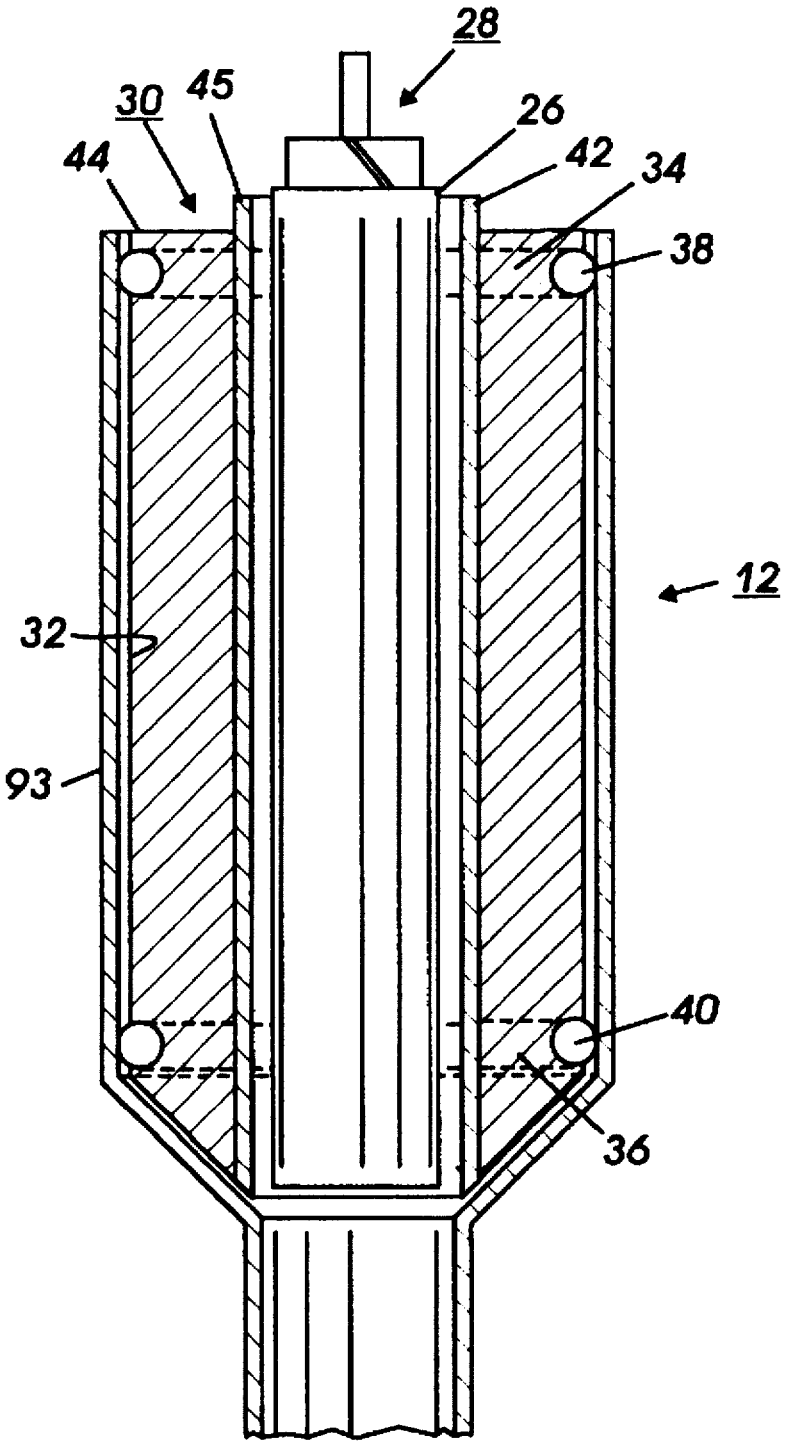
FIG. 4 is a schematic elevation view of the coating vessel shown in FIG. 1 in combination with an insert, mandrel, and a drum substrate which has an outside diameter that is only slightly smaller than the inside diameter of the insert.

FIG. 4, illustrates the coating vessel 12 shown in FIG. 1 in combination with an annular insert 30 and a hollow cylindrical drum substrate 26 which has a relatively small outer diameter compared to the inner diameter of coating vessel 12. Drum substrate 26 is suspended by a conventional mandrel 28 which grips the interior surface of drum substrate 26. When small diameter drums are to be dip coated in coating vessels that have very large inner diameters, the positioning of annular insert 30 within the interior of coating vessel 12 enables achievement of a critical spacing between the outer surface of drum substrate 26 and inner surface 32 of vertical wall 33. Vertical wall 32 is spaced from, adjacent to and parallel to the outer surface of drum substrate 26. Insert 30 may comprise retaining grooves 34 and 36 which retain elastomeric sealing rings 38 and 40, respectively. The sealing rings 38 and 40 may be of any suitable shape. However, elastomeric "O" rings are preferred. If desired, additional retaining grooves and sealing rings (not shown) may be utilized. The sealing rings 38 and 40 prevent coating material from entering and circulating between insert 30 and the adjacent wall of liquid coating vessel 10. Insert 30 comprises a main insert body 41 and insert sleeve 42. Since coating vessels 12 are normally formed from welded sheet metal, the wall 33 is usually not perfectly straight. For example, the wall 33 may have a slightly wavy shaped inner surface 32 which can hamper achievement of laminar flow of the coating material between the inner surface 32 and the outer surface of drum substrate 26. By using resilient elastomeric sealing rings 38 and 40 retained in grooves 34 and 36 extending circumferentially around the outer periphery of insert 30 near the top and at the bottom thereof, alignment of the insert 30 in coating vessel 12 having an imperfectly shaped wall 33 is more readily achieved due to compensating deformation of resilient elastomeric sealing rings 38 and 40. Also, the elastomeric sealing rings 38 and 40 function as a damper to further insulate the insert 30 from external sources of vibration. Any suitable dampening and sealing material may be employed for sealing rings 38 and 40. Typical sealing ring materials include, for example, natural rubber, neoprene, butyl rubber, nitrile rubber, silicone elastomer, Viton, Teflon, and the like. If desired, additional sealing rings may be utilized between the upper ring 38 and the lower ring 40. However, as the number of rings are increased, resistance to insertion and removal of the insert 30 from the coating vessel 12 increases. Instead of the "O" ring configuration illustrated in FIG. 4, the sealing rings may have any other suitable cross section. Typical cross sections include, for example, circular, oval, square, octagonal, star, and the like. Preferably, the sealing rings are resilient and have a durometer of between about 30 and about 100. Each sealing ring should have sufficient thickness so that it is partially compressed when the insert 30 is installed in the coating vessel 12. Thus, each sealing ring 38 and 40 has a thickness that is greater than the depth of the retaining grooves 34 and 36, respectively, which circumscribe the outer surface of the insert 30. The retaining grooves 34 and 36 may have any suitable cross sectional shape such as, for example, square, rectangular, "V", "U", semi-circular and the like. A retaining groove having a square shaped cross section typically has a width between about 0.2 millimeter and about 1 millimeter and a depth of between about 0.2 micrometer and about 1 millimeter. The retaining grooves 38 and 40 are preferably large enough to retain the sealing ring during installation of the insert, after the insert is installed, and during removal from the coating vessel 12. If no sealing rings are employed on the insert body, the liquid coating material 10 can flow between the insert and the coating vessel walls and form undesirable deposits of the coating material 10 on the outer surface of the insert 30 and the inner surface 32 of the coating material vessel 12. These deposits are difficult to remove during cleaning operations following removal of the insert from coating vessel 12.

The main insert body 41 may comprise any suitable material. Preferably, the insert body is made of a plastic, metal or composites. Typical plastics include, for example, polytetrafluoroethylene, nylon, polycarbonate, polyester, UHMW polyethylene or polypropylene, and the like and composites thereof. Typical metals include, for example, stainless steel, aluminum, aluminum alloys, and the like and composites thereof. Main insert body 41 may be solid, foam filled, hollow or the like. A hollow insert body is preferred to reduce weight and to conserve materials. The main insert body may be fabricated by any suitable means such as molding, machining, casting, and the like. The material utilized for the main insert body 41 should not be degradable by the materials employed for coating the drum 26.

Preferably the upper end of insert sleeve 42 extends beyond the top surface 44 of the main insert body 41. This extension of sleeve 42 is preferably thin to isolate the coating being formed on the surface of the drum substrate 26 from ripples formed in the large pool of coating material on top surface 44 flowing away from sleeve 42. The extension of sleeve 42 also facilitates alignment of the upper surface of the sleeve 42 with the upper surface of other like sleeves of other coating vessels in the same coating system so that the amount of overflow out of sleeve 42 is substantially the same for all like sleeves in the same coating system. Insert sleeve 42 may comprise any suitable material such as metal or plastic. Typical metals include, for example, stainless steel, aluminum, aluminum alloys, and the like. Typical plastics include, for example, polytetrafluoroethylene, nylon, polycarbonate, polyester, UHMW polyethylene or polypropylene, and the like. Sleeve 42 preferably comprises a metal because it can be readily fabricated to form a smooth long life surface, such as by machining, to facilitate alignment of the top of sleeve 42 with the tops of other sleeves in the same coating system and to promote laminar flow of coating material 10 as it overflows from the sleeve 42. When multiple coating vessels are utilized in a dip coating system, it is important that the overflow of the coating material over the weir of each coating vessel is substantially the same because that will essentially maintain an even flow of coating material within the interior of the individual tanks in respect to one another. The use of an insert sleeve facilitates alignment of the tops of each sleeve at the same level as the other sleeves in the coating system so that the flow of liquid coating material is smooth and uniform around the periphery of each drum. Although the insert sleeve 42 may be omitted, superior quality coatings are achieved when the sleeve 42 is utilized in an insert. Without sleeve 42, the flat top surface 44 of main insert body 41 creates a relatively large pool of overflowing coating material 10 which is more vulnerable to the formation of ripples caused by sources of vibrational energy. More specifically, vibrational disturbances cause ripples much like the ring shaped ripples that form when a pebble is dropped onto the calm surface of a pond. These ripples propagate in two directions. One towards the substrate that is being withdrawn from the coating bath and the other ripple towards the edge of the coating vessel from which the coating material overflows. The ripples strike and deform the outer surface of the coating carried on the drum 26 while drum 26 is being withdrawn from the bath of coating material 10. The deformations to the coating caused by the ripples can still be detected even after the coating has been dried. Extension of the thin upper end of sleeve 42 above top surface 44 of main insert body 41 reduces the pool area of the coating material as it overflows the top edge 45 of the upper end of sleeve 42 thereby reducing the area available for ripple formation and also aids in isolating drum substrate 26 from the large pool of liquid coating material flowing along the top surface 44 of main insert body 41.

If no sleeve 42 and no sealing rings 38 and 40 are employed with the main insert body 41, the liquid coating material 10 can flow between the insert and the coating vessel walls and reenter the main coating stream at the top of the vessel to cause ripples to form in the liquid coating material 10 flowing along the top surface 44 of main insert body 41. In the absence of an extension of the thin upper end of sleeve 42 above top surface 44, some of these ripples can propagate toward the substrate 26 that is being withdrawn from the bath of coating material 10. As described above, these ripples can strike and deform the outer surface of the coating carried on the drum 26 while drum 26 is being withdrawn from the bath of coating material 10 to cause deformations in the coating which can still be detected even after the coating has been dried. Although the use of a sleeve 42 and sealing rings 38 and 40 are preferred when using an annular insert 30, they may be omitted with less desirable results.

Figure 5:
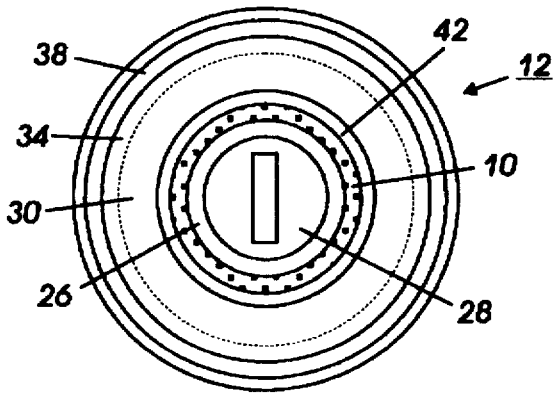
FIG. 5 is a schematic plan view of the combination shown in FIG. 4.

Referring to FIG. 5, a plan view of the coating system of FIG. 4 is shown. Mandrel 28 supports hollow cylindrical drum substrate 26 in liquid coating material 10. Spaced from hollow cylindrical drum substrate 26 is insert sleeve 42 of annular insert 30. Insert 30 is snugly retained within coating vessel 12 by elastomeric sealing rings with only sealing ring 38 seated in being visible.

Figure 6:
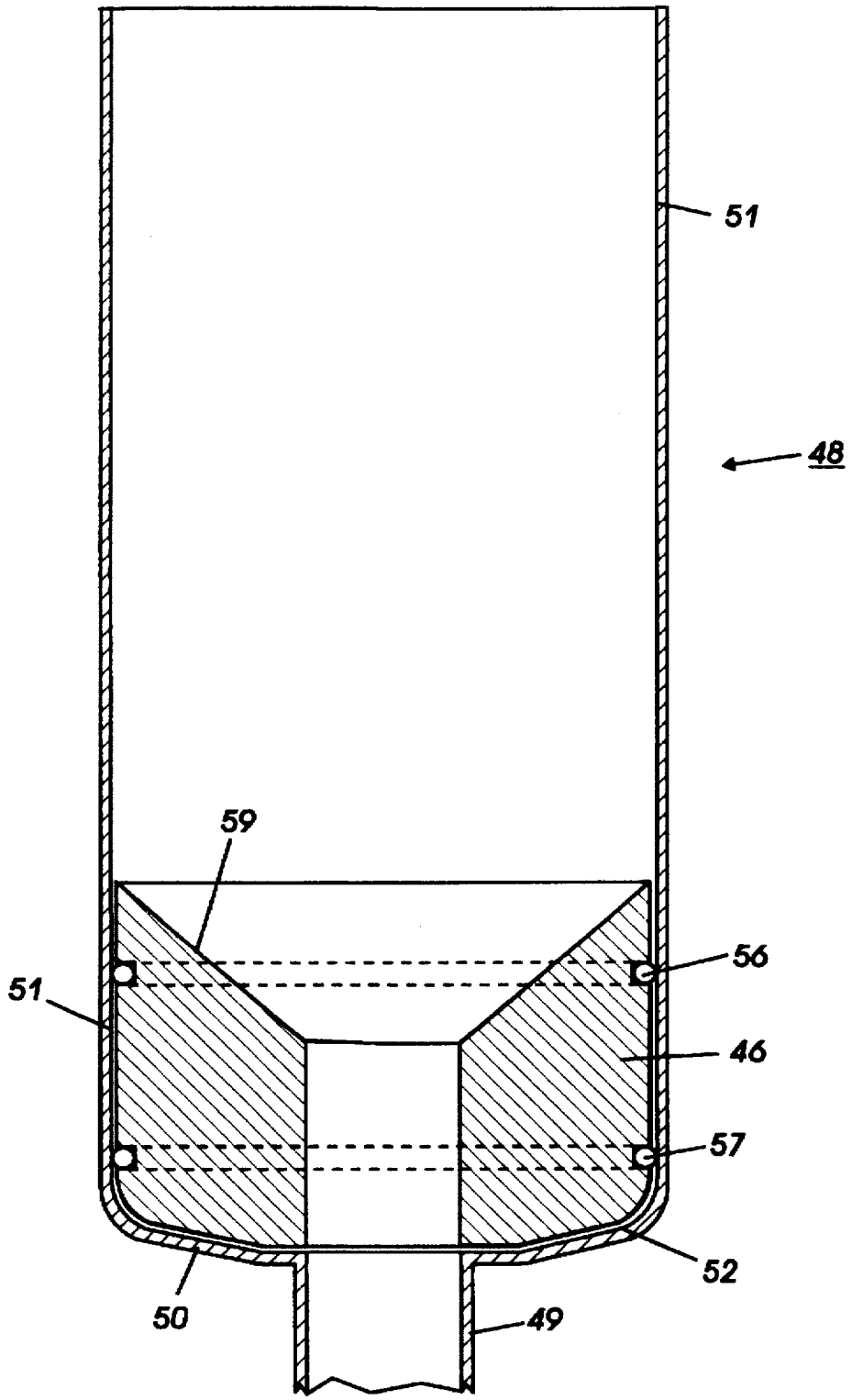
FIG. 6 is a schematic elevation view of a coating vessel having a bottom and an insert.
Figure 7:
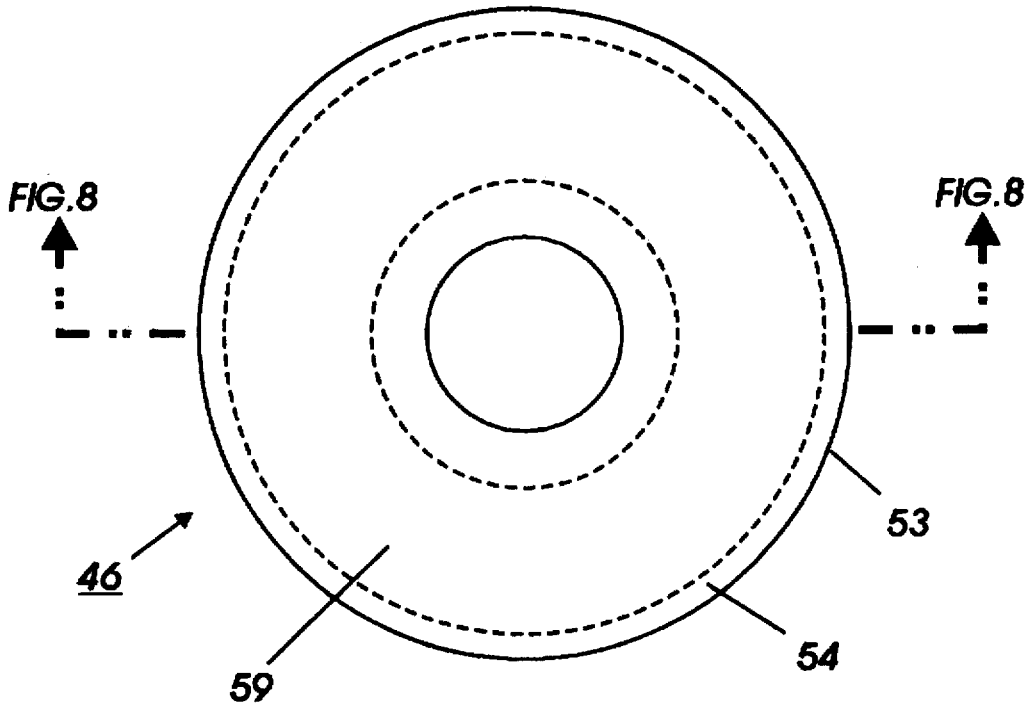
FIG. 7 is a schematic plan view of the bottom insert of FIG. 6.
Figure 8:
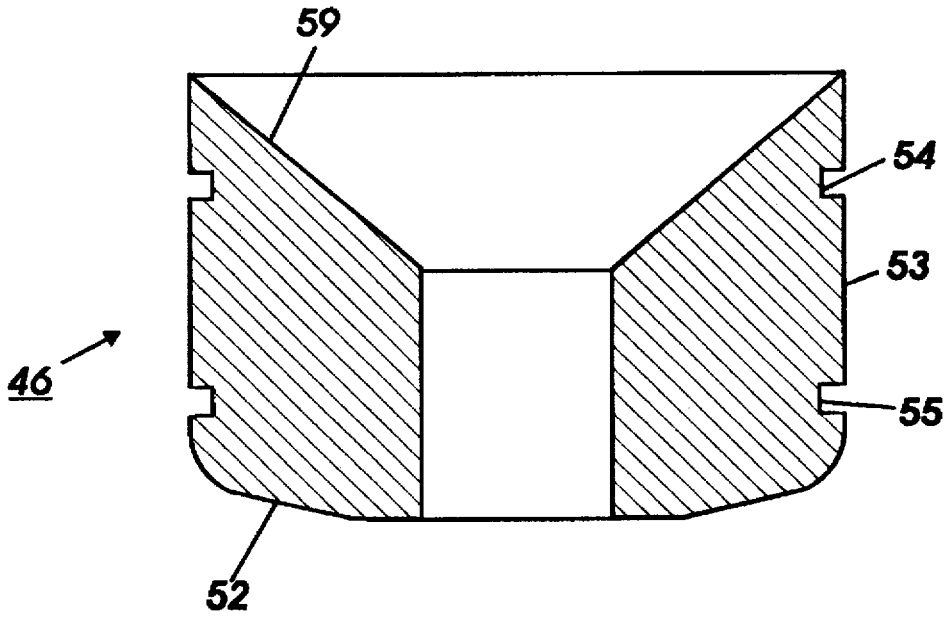
FIG. 8 is a cross sectional schematic elevation view of the bottom insert shown in FIG. 7.

Illustrated in FIGS. 6, 7 and 8, is a bottom insert 46 that is inserted into a coating vessel 48 having a relatively flat bottom 50 and vertical wall 51. Bottom insert 46 aids in the prevention of turbulence in the form of eddies that can develop in the stream of flowing liquid coating material (not shown) as it enters coating vessel 48 through feed inlet 49 and abruptly spreads out along relatively flat bottom 50. Bottom insert 46 has a bottom 52 and vertical side 53 which match the shape of the adjacent interior surface of bottom 50 and vertical wall 53, respectively, of coating vessel 48. The vertical side 51 of bottom insert 46 contains retaining grooves 54 and 55 which retain elastomeric sealing rings 56 and 57, respectively. If desired, additional retaining grooves elastomeric sealing rings (not shown) may be utilized. The sealing rings 56 and 57 prevent coating material from entering and circulating between insert 46 and the adjacent interior surface of bottom 50 and retain bottom insert 46 in position at the bottom of coating vessel 48. Bottom insert 46 has an upper surface 59 shaped like an inverted cone. This cone shape forces the liquid coating material to gradually spread outwardly away from the vertical axis of vessel 48 as it flows into the space between the substrate to be coated (not shown) and the vertical wall 51 of coating vessel 48. To install insert 46, one may merely slide it down to the bottom of vessel 46.

When employing a bottom inset 46, the region in the dip coating vessel 48 below the drum substrate (not shown) at the point of maximum immersion of the drum substrate in the coating material should be sufficiently large to avoid undue restriction of flow and to prevent undesirable turbulence in the coating material as the coating material flows upwardly between the outer surface of the drum and the inner surface of the coating vessel 48 or the inner surface of a coating vessel insert (not shown). Since the relative sizes of the drum, coating vessel, and feed inlet and rate of coating material flow affect the desired size of the region in the dip coating vessel 48 below the drum substrate (not shown) at the point of maximum immersion of the drum substrate, some experimentation is desirable to achieve laminar flow of the coating material in this region. Thus, for example, if the feed inlet 49 diameter which feeds the coating material into the bottom of coating vessel 48 is too narrow compared to the diameter of the coating vessel 48 adjacent the bottom 50 of the coating vessel, 48 the velocity change of the coating material from feed inlet 49 into the low portion of the coating vessel 48 will be too abrupt, laminar flow will be impaired and defects in the coating applied to the drum will occur. More specifically, if the feed inlet 49 has a diameter of about ½ inch (12 millimeters) and the bottom of the coating vessel 48 has a diameter of about 5 inches (12.7 centimeters), the sudden decrease in the velocity of the coating material will disrupt laminar flow and cause coating defects in the final drum coating. This is from about ¼: 1 to about 1:1. Instead of employing the insert described above, abrupt changes in diameter of the means constraining the coating material as it is fed into the bottom of a coating vessel can also be avoided by integrating a funnel shaped entrance at the bottom of the coating vessel when the vessel is initially fabricated, e.g. see FIG. 1. The funnel shape may be achieved, for example, by welding a funnel shaped bottom to the vertical walls of a coating vessel. A flat bottom is always detrimental to the stated objective.

It is noteworthy that even a shallow angled bottom will always cause eddies to form in the recesses of a tight corner and these eddies will form defects on the coating surface. To avoid this occurrence it is necessary to maintain a wide angle where the bottom meets the sides. The optimum angle is 180 degrees. A preferred angle is between about 135 and about 160 degrees and a minimum angle is about 120 degrees. The expression "laminar flow" as employed herein is typically understood to represent a flow of liquid where the flow everywhere in all planes of reference is in the same direction and parallel to the surface of the tube and the tank walls. This flow is smooth, even and totally without turbulence in any region of reference or concern, i.e. "streamlined".

Figure 9:
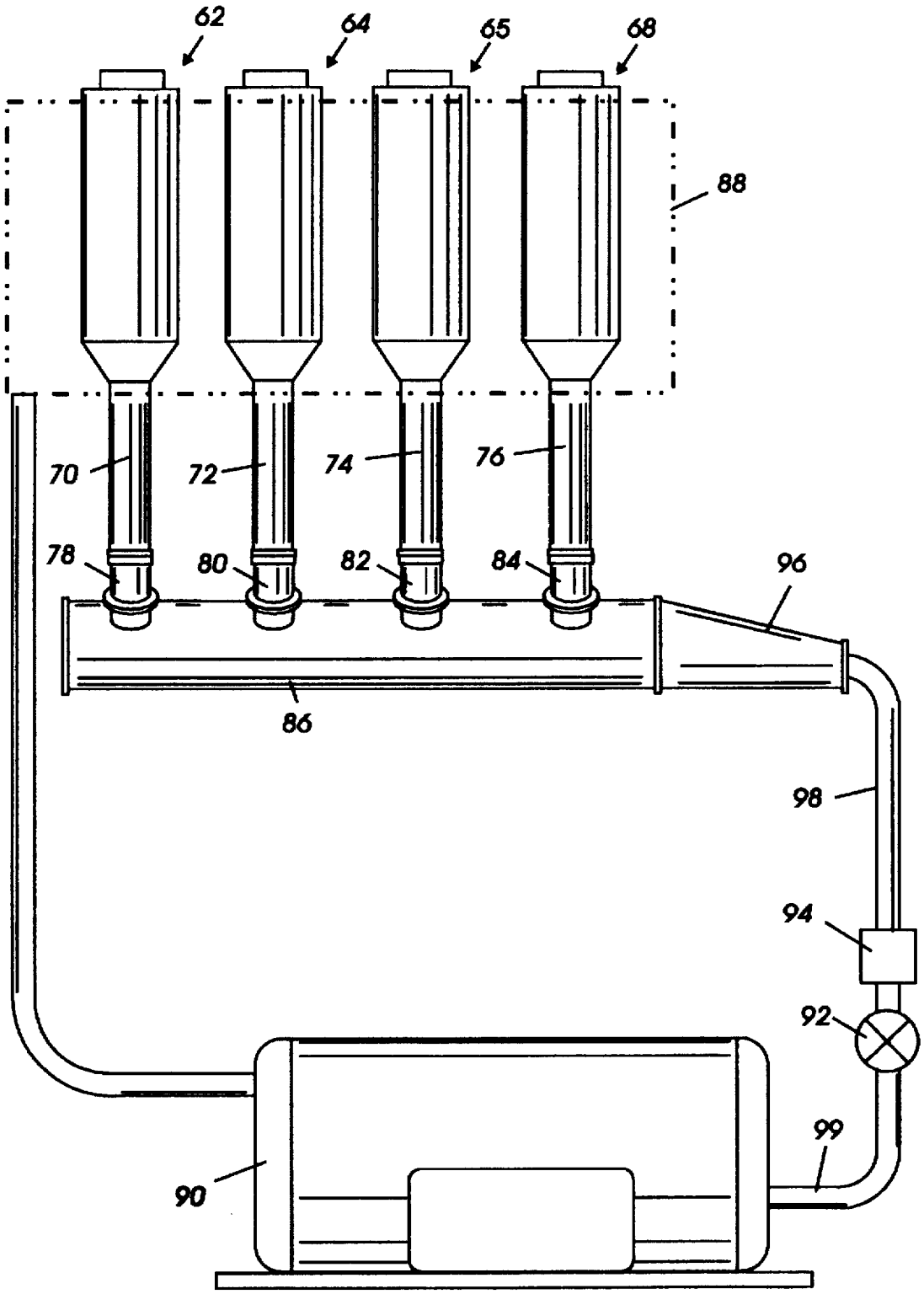
FIG. 9 is a schematic illustration of a coating system of this invention.
Figure 10:
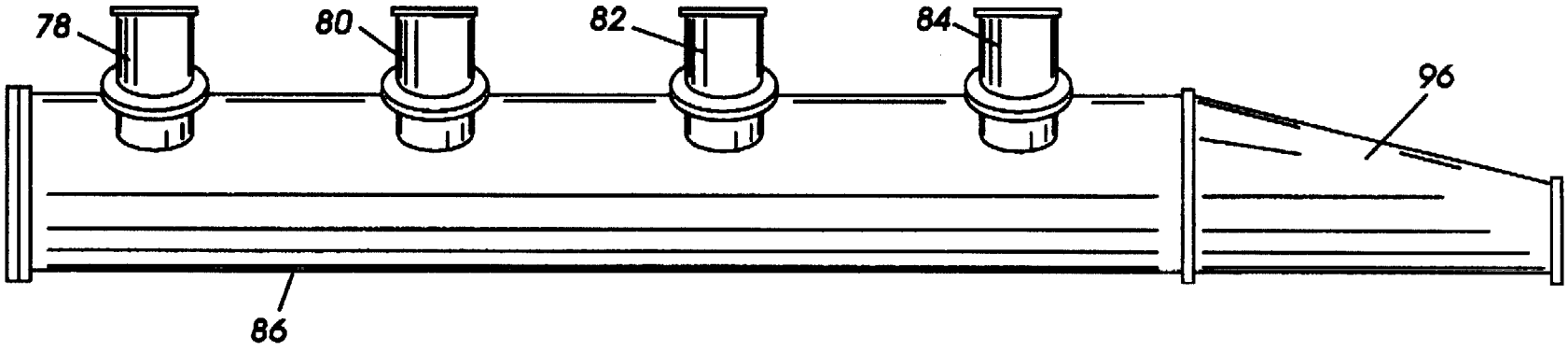
FIG. 10 is a schematic elevation view of the manifold shown in FIG. 9.
Figure 11:
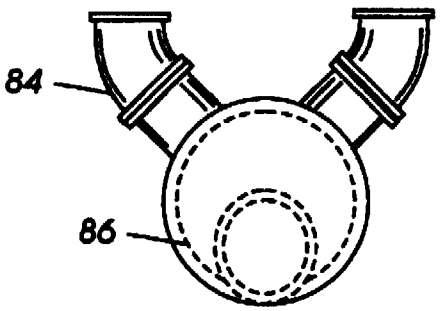
FIG. 11 is a schematic end view of the manifold shown in FIG. 10.

A coating system utilizing eight coating vessels are shown in FIGS. 9, 10 and 11 with only coating vessels 62, 64, 65, and 68 being visible. Liquid coating material is fed to these coating vessels through feed lines 70, 72, 74 and 76, respectively, which are connected in turn through elbow fittings 78, 80, 82 and 84, respectively (the other four feed lines and elbow fittings not being visible in FIGS. 7 and 8) to feed manifold 86. When the coating material, not shown, overflows from the coating vessels into collecting tank 88 (shown in phantom lines), it flows by gravity (a pump may optionally be employed) to reservoir 90. From reservoir 90, the liquid coating material is pumped by a suitable pump 92 through a low pressure filter 94 into the tapered inlet 96 of manifold 86. All bends in the lines between reservoir 90 and the coating vessels should have a large radius of curvature to maintain laminar flow motion of the liquid coating material prior to introduction into the coating vessels. It is also important that the liquid coating material being delivered to the dip coating vessels 62, 64, 65 and 68 be maintained in laminar flow motion prior to introduction into each coating vessel to ensure laminar flow within each coating vessel and to prevent the formation of defects in the applied coating. All feed lines 98 and 99 from reservoir 90 preferably have smooth and electropolished interior surfaces. Thus, for example, the inner surface of each coating vessel and feed lines 70, 72, 74 and 76, elbow fittings 78, 80, 82 and 84 and manifold 86 should be smooth and free of burrs. Also, all piping should not impart sudden changes of direction or velocity to the liquid coating material, particularly, the manifold which delivers the liquid coating material to the individual coating vessels with no change in relative velocity. Thus, for example, it is important that the feed lines 70, 72, 74 and 76 to the feed manifold 86, the manifold itself and the connecting conduits between the manifold and each coating vessel 62, 64, 65 and 68 have substantially the same diameter to maintain laminar flow even though a velocity change will occur as the coating material is transferred from the main feed line 98 to the manifold. Any bends in the lines between the coating material reservoir 90 and the bottom of each coating vessel 62, 64, 65 and 68 should have large radius turns. Generally, the radius bend in any line from reservoir 90 to pump 92 should have a radius of at least about 2 inches (5 centimeters). All bends in lines connecting pump 92 and filter 94 to the manifold 86 should have a radius of at least about 6 inches (15 centimeters). Preferably, all bends in connecting lines between the manifold 86 and the bottom of each coating vessel 62, 64, 65 and 68 have a radius of at least about 8 inches (20 centimeters). Generally, the cross-sectional area of manifold 86 should be equal to about the sum of the cross-sectional areas of each of the connecting lines (passageways) between the manifold and the bottom of each coating vessel. Thus, all joints should have smooth and gradual transitions with absolutely no abrupt change in direction. Similarly, abrupt restrictions which would impede flow of the liquid coating material should be avoided in the liquid coating material delivery system between the reservoir 90 and the bottom each coating vessel 62, 64, 65 and 68. Thus, for example, any valves utilized in the coating system should be free of any components which would restrict the coating material flow during the coating operation. Preferred valves which do not restrict flow when opened include, for example, ball valves and plug valves which when open provide exactly the same interior cross section as the incoming and out going connecting lines. Undesirable valves which tend to restrict flow even in the open position include, for examples, gate valves, shutter valves, needle valves, and the like.

It is also important that other devices be avoided which might cause a large pressure drop and disrupt laminar flow such as conventional filters, instrumentation, including viscometers and temperature probes extending into the liquid flow path, and the like. However, a low back pressure filter 94 may be utilized in the main feed line 98 between the manifold and coating material pump. The low back pressure filter 98 should be impart a pressure drop of less than about 2 pounds per square inch (0.14 kilograms per square centimeter). Typical low back pressure filters comprise a convoluted filter membrane resembling an extensively pleated sheet surrounding an open core. The coating material pumped through this type of filter undergoes essentially zero pressure drop because of the huge area available for filtering.

Generally, pressure in the liquid coating material between the pump 92 and the bottom of each coating vessel is less than about 1 pound per square inch (0.07 kilograms per square centimeter) during the coating cycle. It is important that the pressure is equal in all directions in the coating material liquid in order to achieve laminar flow in the manifold and in the lines connecting the manifold 86 to the bottom of each coating vessel.

The dip coating system of this invention transports and recirculates liquid coating material while isolating the coating material from various energy inputs or losses to produce a consistently uniform and defect free coating. Thus, for example, all sources of heat and vibration should be isolated from the liquid coating material. For example, pump motors which generate heat during operation, such as gear pumps, are to be avoided because they can cause agglomeration of pigment particles and separation of the dispersion in liquid coating compositions such as coatings for charge generation layers. The liquid coating material pump preferably provides uniform delivery of the coating liquid to a manifold and each coating vessel without imparting any significant heat energy to the flowing liquid coating material. The pump should be a low shear pump. Typical low shear pumps include, for example, sine pumps, auger pumps, centrifugal pumps, oil-less diaphragm pumps (acetal, teflon). Also included are two or three small pumps running out of phase with each other such as peristaltic pumps, sine pumps, auger pumps, centrifugal pumps, oil-less diaphragm pumps (acetal, teflon), and the like. Although less desirable, a high shear pump such as a gear pump may be utilized if it is positioned far upstream from the manifold and sufficient filters are interposed between the high shear and the manifold to remove agglomerated materials.

Isolation from vibration can be aided by mounting coating vessels, manifold, feed lines and the like on vibration absorbing means such as rubber pads, springs, elastomeric members, and the like.

Heat exchangers may be utilized to prevent large changes in the temperature of the liquid coating material. Thus, the total fluctuation or variation in temperature of the coating liquid in the manifold, feed lines between the manifold and the bottom of the coating vessel and in each coating vessel should be maintained at a level of less than about 2° C. Temperature fluctuations in the liquid coating material greater than about 2° C. tends to cause streaks to form in the applied coating, particularly in charge generator layers. Optimum results are achieve when the total variation in temperature of the liquid coating material is maintained less than about 0.5° C. When temperature fluctuations reach 3° C., the liquid coating material is totally unsatisfactory for forming uniform deposited coatings. Maintenance of temperature fluctuation to less than about 2° C. can be achieved, for example, with coating booths and water jackets which surround the coating vessel, feed line, pump, filter or the like, the temperature of which can be computer controlled using conventional temperature sensors and feedback means. Air flow in the coating environs must also be regulated to less than 1° C. of variation, and direct air flows at the wet surfaces of freshly coated parts should be directed away by means of a shield or an incoming vent which will suitably dissipate the air flow so that it will not impinge and distort any wet coated surface.

Satisfactory results are achieved with an upward liquid coating material velocity of between about 15 millimeters per minute and about 300 millimeters per minute between the outer surface of the drum and the vertical inner wall of the coating vessel. Preferably, the upward velocity is maintained at between about 100 millimeters per minute and about 200 millimeters per minute. This velocity is measured at the center of, i.e. midway between, the space between the inner vessel and the outer surface of the drum being coated as the drum is being withdrawn from the liquid coating mixture. Although the velocity of the liquid coating material near the inner surface of the coating vessel and the outer surface of the drum are lower than the velocity at the center of the space between the drum and the vessel wall, the flow of the coating material is laminar. Obviously, the center of the space between the drum and the vessel wall intersects an imaginary curved, cylindrically shaped plane that is coaxial with the drum and the adjacent inner surface of the coating vessel.

Electrostatographic imaging members (photoreceptors) are well known in the art. The electrostatographic imaging member may be prepared by various suitable techniques. Typically, a substrate is provided having an electrically conductive surface. At least one photoconductive layer is then applied to the electrically conductive surface. An optional thin charge blocking layer may be applied to the electrically conductive layer prior to the application of the photoconductive layer. For multilayered photoreceptors, a charge generation layer is usually applied onto the blocking layer and charge transport layer is formed on the charge generation layer. For single layer photoreceptors, the photoconductive layer is a photoconductive insulating layer and no separate, distinct charge transport layer is employed.

Any suitable size drum may be coated with the process of this invention. Typical drum diameters include, for example, diameters of about 30 millimeters, 40 millimeters, 85 millimeters, and the like. Preferably, the surface of the drum being coated is smooth. However, if desired, it may be slightly roughened by honing, sand blasting, grit blasting, and the like. Such slight roughening forms a surface which varies from average diameter by less than about plus or minus 3 micrometers. The surface of the drum being coated is preferably inert to the components in the liquid coating material. The drum surface may be a bare, uncoated surface or may comprise a previously deposited coating or coatings. The substrate may be opaque or transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. Typical metal substrates include, for example, aluminum, stainless steel, nickel, aluminum alloys, and the like. The electrically insulating or conductive substrate should be rigid and in the form of a hollow cylindrical drum. Preferably, the substrate comprises a metal such as aluminum.

The thickness of the substrate layer depends on numerous factors, including resistance to bending and economical considerations, and thus this layer for a drum may be of substantial thickness, for example, about 5 millimeters, or of minimum thickness such as about 1 millimeter, provided there are no adverse effects on the final electrostatographic device.

The conductive layer may vary in thickness over substantially wide ranges depending on the optical transparency desired for the electrostatographic member. Accordingly, the conductive layer and the substrate may be one and the same or the conductive layer may comprise a coating on the substrate. Where the conductive layer is a coating on the substrate, the thickness of the conductive layer may be as thin as about 50 angstroms, and more preferably at least about 100 Angstrom units for optimum electrical conductivity. The conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like.

Regardless of whether a conductive metal layer is the substrate itself or a coating on the substrate, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. The conductive layer need not be limited to metals. Other examples of conductive layers may be combinations of materials such as conductive Indium tin oxide or carbon black loaded polymer. A typical surface resistivity for conductive layers for electrophotographic imaging members in slow speed copiers is about $10^2$ to $10^3$ ohms/square.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Typical blocking layers include, for example, polyamides, polyvinylbutyrals, polysiloxanes, polyesters, and the like and mixtures thereof. The blocking layer may be nitrogen containing siloxanes or nitrogen containing titanium compounds such as trimethoxysilyl propylene diamine, hydrolyzed trimethoxysilyl propyl ethylene diamine, N-beta (aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $(H_2N(CH_2)_4)CH_3Si(OCH_3)_2$, (gamma-aminobutyl) methyl diethoxysilane, and $(H_2N(CH_2)_3)CH_3Si(OCH_3)_2$(gamma-aminopropyl) methyl diethoxysilane, as disclosed in U.S. Pat. No. 4,338,387, U.S. Pat. No. 4,286,033 and U.S. Pat. No. 4,291,110. The disclosures of U.S. Pat. No. 4,338,387, U.S. Pat. No. 4,286,033 and U.S. Pat. No. 4,291,110 are incorporated herein in their entirety. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage. Drying of the deposited coating may be effected by any suitable conventional technique such as oven drying, infra red radiation drying, air drying and the like.

Any suitable photogenerating layer may be applied to the blocking layer. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light. Generally, the average particle size of the pigment dispersed in the charge generating layer is less than about 1 micrometer. A preferred average size for pigment particles is between about 0.05 micrometer and about 0.2 micrometer.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include resins such as polyvinylbutyral, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, and the like and mixtures thereof. These polymers may be block, random or alternating copolymers.

Any suitable solvent may be employed to dissolve the film forming binder. Typical solvents include, for example, n-butyl acetate, methylene chloride, tetrahydrofuran, cyclohexanone, iso-butyl acetate, toluene, methyl ethyl ketone, and the like.

Satisfactory results may be achieve with a pigment to binder weight ratio of between about 40:60 and about 95:5. Preferably, the pigment to binder ratio is between about 50:50 and about 90:10. Optimum results may be achieved with a pigment to binder ratio of between about 60:40 and about 80:20 ratio.

Various factors affect the thickness of the deposited charge generating layer coating. These factors include, for example, the solids loading of the total liquid coating material, the viscosity of the liquid coating material, and the relative velocity of the liquid coating material in the space between the drum surface and coating vessel wall. Satisfactory results are achieved with a solids loading of between about 2 percent and about 12 percent based on the total weight of the liquid coating material; the "total weight of the solids" being the combined weight of the film forming binder and pigment particles and the "total weight of the liquid coating material" being the combined weight of the film forming binder, the solvent for the binder and pigment particles. Preferably, the liquid coating mixture has a solids loading of between about 3 percent and about 8 percent by weight based on the total weight of the liquid coating material. The thickness of the deposited coating varies with the specific solvent, film forming polymer and pigment materials utilized for any given coating composition. For thin coatings, a relatively slow drum withdrawal (pull) rate is desirable when utilizing high viscosity liquid coating materials. Generally, the viscosity of the liquid coating material varies with the solids content of the liquid coating material. Satisfactory results may be achieved with viscosities between about 1 centipoise and about 100 centipoises. Preferably, the viscosity is between about 2 centipoises and about 10 centipoises.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

Any suitable and conventional technique may be utilized to dry the deposited coating. Typical conventional techniques include, for example, oven drying, infra red radiation drying, air drying and the like. After drying, the deposited charge generating layer thickness generally ranges in thickness of from about 0.1 micrometer to about 5 micrometers, and preferably between about 0.05 micrometer and about 2 micrometers. Optimum results are achieved with a dry charge generating layer thickness of between about 0.1 and about about 0.2 micrometer. The desired photogenerating layer thickness is related to binder content. Higher binder content compositions generally require thicker layers for photogeneration. Thicknesses outside these ranges can be selected providing the objectives of the present invention are achieved.

The active charge transport layer may comprise an activating compound useful as an additive dispersed in electrically inactive polymeric materials render these materials electrically active. These activating compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. A typical transport layer employed in one of the two electrically operative layers in multilayered photoconductors comprises from about 25 percent to about 75 percent by weight of at least one charge transporting aromatic amine compound, and about 75 percent to about 25 percent by weight of a polymeric film forming resin in which the aromatic amine is soluble. The charge transport layer forming mixture may, for example, comprise an aromatic amine compound of one or more compounds having the general formula:

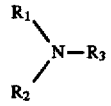

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free from electron withdrawing groups such as $NO_2$ groups, CN groups, and the like. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2', 2"-dimethyltriphenylmethane, N,N'-bis(alkylphenyl)-(1,1'-biphenyl)-4,4'-diamine wherein the alkyl is, for example, methyl, ethyl, propyl, n-butyl, etc., N,N'-diphenyl-N,N'-bis(chlorophenyl)-(1,1'-biphenyl)-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the photoreceptor. Typical inactive resin binders soluble in methylene chloride include polycarbonate resin, polyvinylcarbazole, polyester, polyarylate, polyacrylate, polyether, polysulfone, and the like. Molecular weights can vary, for example, from about 20,000 to about 150,000.

Any suitable and conventional technique may be utilized to mix the charge transport layer coating mixture. A preferred coating technique utilizes the dip coating system of this invention. Various factors affect the thickness of the dip deposited charge transport layer coating. These factors include, for example, the solids loading of the total liquid coating material, the viscosity of the liquid coating material, and the relative velocity of the liquid coating material in the space between the drum surface and coating vessel wall. Satisfactory results are achieved with a solids loading of between about 15 percent and about 35 percent based on the total weight of the liquid coating material; the "total weight of the solids" being the combined weight of the film forming binder and the activating compound and the "total weight of the liquid coating material" being the combined weight of the film forming binder, the activating compound and the solvent for the binder and activating compound. Preferably, the liquid charge transport layer coating mixture has a solids loading of between about 3 percent and about 6 percent by weight based on the total weight of the liquid coating material. The thickness of the deposited coating varies with the specific solvent, film forming polymer and activating compound utilized for any given coating composition. For thin coatings, a relatively slow drum withdrawal (pull) rate is desirable when utilizing high viscosity liquid coating materials. Generally, the viscosity of the liquid coating material varies with the solids content of the liquid coating material. Satisfactory results may be achieved with viscosities between about 100 centipoise and about 1000 centipoises. Preferably, the viscosity is between about 200 centipoises and about 500 centipoises. Drying of the deposited coating may be effected by any suitable conventional technique such as oven drying, infra red radiation drying, air drying and the like.

Generally, the thickness of the hole transport layer is between about 10 to about 50 micrometers after drying, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. Overcoatings are continuous and generally have a thickness of less than about 10 micrometers.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was dip coated using a stainless steel coating vessel similar to the coating vessel illustrated in FIG. 1. The coating vessel had a cylindrically shaped upper section having an inside diameter of 110 centimeters and a vertical wall of 435 centimeters. The cylindrically shaped upper section had a wall thickness of about 2 millimeters. The lower section of the coating vessel had the shape of an inverted cone. The uppermost part of the inverted cone section had a diameter equal to the diameter of the cylindrically shaped upper section. The lowermost part of the inverted cone section contained an opening having an inside diameter of 10 millimeters. This opening was connected to a feed inlet pipe having an inside diameter of 10 millimeters. The slope of the inverted cone was 45 degrees measured from an imaginary horizontal plane which intersected the opening. Liquid coating material was pumped from a liquid coating material reservoir tank to the feed inlet pipe by means of a MICRO pump (Model GM-8, available from Siewert Co.) which pumped the coating material through a PALL filter (Model AB1Y070, available from Prosco Products Co.) and a manifold to the feed inlet pipe in a system similar to that shown in FIGS. 9, 10 and 11. The pressure drop across the filter was 5 pounds per square inch (351.5 grams per square centimeter). There were five 90 degree bends in the piping between the pump and the bottom of the coating vessel. All bends in the piping had a radius of curvature—from zero to twenty centimeters. The top of the coating vessel was open. The coating material flowed from the bottom of the coating vessel, through the cylindrically shaped upper section and overflowed the top edge of the cylindrically shaped upper section of the coating vessel. The coating material which overflowed from the top of the coating vessel was caught in a collecting tank and recirculated to the reservoir tank. A water jacket was used around the collection/recirculation tank to maintain the temperature of the coating solution within about 3° C. of a mean temperature of 18° C. Also, a coating booth containing the entire coating system was maintained at a temperature of 18° C.

An aluminum drum substrate having a thickness of 1 millimeters, an outside diameter of 40 centimeters and a length of 238 centimeters was provided that already had a 1000. Angstrom thick coating of a siloxane charge blocking layer. This coated drum was dip coated by immersing all, but 5 millimeters of the top of edge, of the drum into the bath of coating material contained in the coating vessel. The drum was transported using a conventional mandrel and conveyor system. The mandrel gripped the interior surface of the upper part of the drum and aligned the drum coaxially with the cylindrically shaped upper section of the coating vessel. The radial spacing between the outer surface of the drum and the adjacent inner surface of the coating vessel was 35 millimeters. The liquid coating material comprised a photogenerating layer (CGL) containing 5.0 percent by weight titanyl phthalocyanine and chloroindium phthalocyanine pigment particles with polyvinyl butyral (B79, available from Monsanto Co.) binder with 95 percent n-butyl acetate as solvent. —The pigment particles had an average particle size of about 0.2 micrometer. This liquid coating material has a viscosity of 10 centipoises. The pigment to binder weight ratio was 64:36. The velocity of the coating material as it flowed between the outer surface of the submerged portion of the drum and the adjacent vertical inner wall of the coating vessel was about 27.2 millimeters per minute, the velocity being measured midway between the outer surface of the drum and the adjacent vertical inner wall of the vessel. —The drum was withdrawn from the coating bath at a rate of 185 millimeters per minute. The resulting coating was dried at 135° C. for 5 minutes in a forced air oven to form a dry thickness photogenerating layer having a thickness of about 0.2 micrometer.

This photogenerator layer was overcoated with a charge transport layer. The charge transport layer coating material contained a 25 percent by weight solids solution of an arylamine hole transporting molecule poly(4,4'-diphenyl-1, 1'-cyclohexane carbonate) (PCZ-200, available from Mitsubishi Gas Chemical), and 75 percent by weight mono chloro benzene. This solution was applied on the photogenerator layer by dip coating to form a coating which upon drying had a thickness of 24 microns. Dip coating was performed with a stainless steel coating vessel identical to the coating vessel used above for applying the charge generator layer. The coating vessel had a cylindrically shaped upper section having a diameter of 110 centimeters and a vertical wall of 2 centimeters. The lower section of the coating vessel had the shape of an inverted cone. The uppermost part of the inverted cone section had a diameter equal to the diameter of the cylindrically shaped upper section. The lowermost part of the inverted cone section contained an opening having a diameter of 10 millimeters. This opening was connected to a feed inlet pipe having a diameter of 10 millimeters. Liquid coating material was pumped from a liquid coating material reservoir tank to the feed inlet pipe by means of a MICRO pump (Model GM-8, available from Siewert Co.) which pumped the coating material through a PALL filter (Model AB1Y070, available from Prosco Products Co.) and a manifold to the feed inlet pipe in a system similar to that shown in FIGS. 9, 10 and 11. There were 4 bends in the piping between the pump and the bottom of the coating vessel. All bends in the piping had a radius of curvature from zero to twenty centimeters. The top of the coating vessel was open. The coating material flowed from the bottom of the coating vessel, through the cylindrically shaped upper section and overflowed the top edge of the cylindrically shaped upper section of the coating vessel. The coating material which overflowed was caught in a collecting tank and recirculated to the reservoir tank. During this coating process the humidity was equal to or less than 15 percent. The photoreceptor device containing all of the above layers was annealed at 135° C. in a forced air oven for 45 minutes and thereafter cooled to ambient room temperature.

This control photoreceptor was examined and found to contain visible streaks in the applied coatings. The photoreceptor was also used to make copies in a Xerox 4213 printer. It was also found that electrophotographic copies made with this photoreceptor were characterized by-streaks which appeared to start at the top and extend to the bottom, sometimes splitting or forking into two or more streaks or clear appearing regions as they progressed towards the bottom. Each drum had one or more, and they showed up on the corresponding copies as deletions or areas that will not print dark as they will not accept toner.

EXAMPLE II

The procedures for preparing a photoreceptor as described in Example I were repeated to form another test sample, except that the solvent for the charge generator layer was n-butyl acetate instead of cyclohexanone. After all the coatings were applied and the photoreceptor device was annealed at 135° C. in a forced air oven for 5 minutes and cooled to ambient room temperature, this control photoreceptor was tested as described in Example I. This control photoreceptor contained severe visible streaks in the applied coatings. The copies made were examined and found to contain severe visible streaks in the applied coatings. It was also found that electrophotographic copies made with this photoreceptor were characterized by streaks which appeared to start at the top and extend to the bottom, sometimes splitting or forking into two or more streaks or clear appearing regions as they progressed towards the bottom. Each drum had one or more, and they showed up on the corresponding copies as deletions or areas that would not print dark as they would not accept toner.

EXAMPLE III

The procedures for preparing a photoreceptor as described in Example I were repeated to form another test sample, except that the coating vessel was replaced with another stainless steel coating vessel having a shape similar to the coating vessel illustrated in FIG. 1, but having a cylindrically shaped upper section having a diameter of 55 centimeters and a vertical wall of 435 centimeters. The sample prepared using identical 40 centimeter diameter aluminum drum was evaluated in the same manner as that described in Examples I and II. This photoreceptor sample was free of streaks in the coating and performed well in a machine test identical to the machine test described in Example I. When the processes of Examples I, II and III were repeated to fabricate 30 photoreceptors for each process and tested as described in Examples I and II, it was found that 100 percent of the photoreceptors made by the process of Examples I and II contained unacceptable defects whereas all of the photoreceptors made with the procedure of Example III were free of defects.

EXAMPLE IV

The procedures for preparing a photoreceptor as described in Example I were repeated to form another test sample, except that an annular insert similar to the insert illustrated in FIG. 4 was added to the interior of the coating vessel. The insert had an outer diameter that was 2 millimeters less than the inside diameter of the coating vessel. The annular insert also had a vertically aligned cylindrically shaped opening which effectively reduced the inside diameter of the coating vessel from 110 millimeters down to 55 millimeters. A pair of Teflon encapsulated neoprene "O" rings having a thickness of 5 millimeters where positioned in circumferential grooves located near the top and bottom of the annular insert. Each of the grooves had a depth of 3 millimeters and a width of 5 millimeters. The "O" rings were compressed when the insert was installed in the coating vessel and prevented flow of coating material between the insert and the adjacent wall of the coating vessel.

An aluminum drum substrate having a thickness of 1 millimeter, an outside diameter of 40 centimeters and a length of 340 millimeters was provided that already had a 1000 Angstrom thick coating of a siloxane charge blocking layer. This coated drum was dip coated by immersing all, but 5 millimeters of the top of edge, of the drum into the bath of coating material contained in the coating vessel. The drum was transported using a conventional mandrel and conveyor system. The mandrel gripped the interior surface of the upper part of the drum and aligned the drum coaxially with the cylindrically shaped upper section of the coating vessel. The radial spacing between the outer surface of the drum and the adjacent inner surface of the coating vessel was 7.5 millimeters. The liquid coating material comprised a photogenerating layer (CGL) containing 5 percent by weight titanyl phthalocyanine and chloroindium phthalocyanine pigment particles with polyvinyl butyral (B79, available from Monsanto Co.) binder with 95 percent n-butyl acetate as solvent. The pigment particles had an average particle size of about 0.2 micrometer. This liquid coating material has a viscosity of 8 centipoises. The pigment to binder weight ratio was 64 :36. The velocity of the coating material as it flowed between the outer surface of the submerged portion of the drum and the adjacent vertical inner wall of the coating vessel was about 27 millimeters per minute, the velocity being measured midway between the outer surface of the drum and the adjacent vertical inner wall of the vessel. The flowing coating material between the outer surface of the submerged portion of the drum and the adjacent vertical inner wall of the coating vessel was laminar. Laminar flow was determined by observing the flow appearance at the top of the coating vessel. The flow velocity of the coating material as it passed between the outer surface of the drum and the vertical inner wall of the vessel was 27 millimeters per minute, the velocity being measured midway between the outer surface of the drum and the vertical inner wall of the coating vessel. The drum was withdrawn from the coating bath at a rate of 185 millimeters per minute. The resulting coating was dried at 135° C. for 5 minutes in a forced air oven to form a dry thickness photogenerating layer having a thickness of about 0.2 micrometer.

Dramatic differences were observed between the results obtained in Example I and the results obtained with the insert. A comparison of the results are shown in Table A below:

TABLE A

| Dip Tank Diameter | Production Exp # | Streak Defect Reject Level % | Number of Streaks/Drum |
|---|---|---|---|
| 110 mm | 1,2,3,4 | 100 | 1.5–2.5 |
| 55 mm (insert) | 7 | 12 | 0.1 |

Table A clearly demonstrates that the insert eliminated streaking whereas streaking was excessive in the absence of the insert.

EXAMPLE V (1) A photoconductive imaging member was dip coated using a stainless steel coating vessel similar to the coating vessel illustrated in FIG. 1. The coating vessel had a cylindrically shaped upper section having an inside diameter of 110 centimeters and a vertical wall of 435 centimeters. The cylindrically shaped upper section had a wall thickness of about 2 millimeters. The lower section of the coating vessel had the shape of an inverted cone. The uppermost part of the inverted cone section had a diameter equal to the diameter of the cylindrically shaped upper section. The lowermost part of the inverted cone section contained an opening having an inside diameter of 35 millimeters. This opening was connected to a feed inlet pipe having an inside diameter of 35 millimeters. The slope of the inverted cone was 45 degrees measured from an imaginary horizontal plane which intersected the opening. Liquid coating material was pumped from a liquid coating material reservoir tank to the feed inlet pipe by means of a MICRO pump (Model GM-8, available from Siewert Co.) which pumped the coating material through a manifold to the feed inlet pipe in a system similar to that shown in FIGS. 9, 10 and 11. There was only one ten centimeter bend in the piping between the pump and the bottom of the coating vessel. The top of the coating vessel was open. The coating material flowed from the bottom of the coating vessel, through the cylindrically shaped upper section and overflowed the top edge of the cylindrically shaped upper section of the coating vessel. The coating material which overflowed from the top of the coating vessel was caught in a collecting tank and recirculated to the reservoir tank.

(2) An aluminum drum substrate having a thickness of 1 millimeter, an outside diameter of 40 centimeters and a length of 238 centimeters was provided that already had a 1000. Angstrom thick coating of a siloxane charge blocking layer. This coated drum was dip coated by immersing all, but 5 millimeters of the top of edge, of the drum into the bath of coating material contained in the coating vessel. The drum was transported using a conventional mandrel and conveyor system. The mandrel gripped the interior surface of the upper part of the drum and aligned the drum coaxially with the cylindrically shaped upper section of the coating vessel. The radial spacing between the outer surface of the drum and the adjacent inner surface of the coating vessel was 35 millimeters. The liquid coating material comprised a photogenerating layer (CGL) containing 5.0 percent by weight titanyl phthalocyanine and chloroindium phthalocyanine pigments with polyvinyl butyral (B79, available from Monsanto Co.) binder with 95 percent n-butyl acetate as solvent.

(3) The pigment particles had an average particle size of about 0.2 micrometers. This liquid coating material has a viscosity of 10 centipoises. The pigment to binder weight ratio was 64:36. The velocity of the coating material as it flowed between the outer surface of the submerged portion of the drum and the adjacent vertical inner wall of the coating vessel was about 27.2 millimeters per minute, the velocity being measured midway between the outer surface of the drum and the adjacent vertical inner wall of the vessel.

A small shell and tube type heat exchanger was installed into the delivery line adjacent to the bottom of the coating vessel and at the entrance to the manifold. A drum was dipped into the coating vessel as described above. The resultant coating was free of streaks, which demonstrated that the presence of the heat exchanger in the line, in and of itself, did not cause streaks in the coating. Next, the heat exchanger was connected to a warm water source. A thermometer was immersed into the coating vessel and the warm water was allowed to flow to the heat exchanger, thereby heating the coating solution as it passed into the bottom of the coating vessel. At the very moment that the warmed solution reached the coating vessel, indicated by the thermometer, a drum was dipped into the coating vessel as described above. The coating solution temperature rose three degrees centigrade while the drum was immersed. The resultant coating was covered with streaks, which demonstrated that the addition of heat by the heat exchanger to the solution caused streaks in the coating. Another drum was dipped immediately thereafter into the coating vessel as described above. At this point the temperature had risen 5 degrees centigrade in the coating vessel. This coating was completely covered with multiple streaks. This coating material cannot flow through any hot devices, nor can it experience any sudden temperature change, on its way to the coating vessel or severe rejects in the coating will be formed.

EXAMPLE VI (1) A photoconductive imaging member was dip coated using a stainless steel coating vessel similar to the coating vessel illustrated in FIG. 1. The coating vessel had a cylindrically shaped upper section having an inside diameter of 110 centimeters and a vertical wall of 435 centimeters. The cylindrically shaped upper section had a wall thickness of about 2 millimeters. The lower section of the coating vessel had the shape of an inverted cone. The uppermost part of the inverted cone section had a diameter equal to the diameter of the cylindrically shaped upper section. The lowermost part of the inverted cone section contained an opening having an inside diameter of 35 millimeters. This opening was connected to a feed inlet pipe having an inside diameter of 35 millimeters. The slope of the inverted cone was 45 degrees measured from an imaginary horizontal plane which intersected the opening. Liquid coating material was pumped from a liquid coating material reservoir tank to the feed inlet pipe by means of a MICRO pump (Model GM-8, available from Siewert Co.) which pumped the coating material through a manifold to the feed inlet pipe in a system similar to that shown in FIGS. 9, 10 and 11. There was only one ten centimeter bend in the piping between the pump and the bottom of the coating vessel. The top of the coating vessel was open. The coating material flowed from the bottom of the coating vessel, through the cylindrically shaped upper section and overflowed the top edge of the cylindrically shaped upper section of the coating vessel. The coating material which overflowed from the top of the coating vessel was caught in a collecting tank and recirculated to the reservoir tank.

(2) An aluminum drum substrate having a thickness of 1 millimeter, an outside diameter of 40 centimeters and a length of 238 centimeters was provided that already had a 1000 Angstrom thick coating of a siloxane charge blocking layer. This coated drum was dip coated by immersing all, but 5 millimeters of the top of edge, of the drum into the bath of coating material contained in the coating vessel. The drum was transported using a conventional mandrel and conveyor system. The mandrel gripped the interior surface of the upper part of the drum and aligned the drum coaxially with the cylindrically shaped upper section of the coating vessel. The radial spacing between the outer surface of the drum and the adjacent inner surface of the coating vessel was 35 millimeters. The liquid coating material comprised a photogenerating layer (CGL) containing 5.0 percent by weight titanyl phthalocyanine and chloroindium phthalocyanine pigment particles with polyvinyl butyral (B79, available from Monsanto Co.) binder with 95 percent n-butyl acetate as solvent.

(3) The pigment particles had an average particle size of about 0.2 micrometers. This liquid coating material has a viscosity of 10 centipoises. The pigment to binder weight ratio was 64:36. The velocity of the coating material as it flowed between the outer surface of the submerged portion of the drum and the adjacent vertical inner wall of the coating vessel was about 27.2 millimeters per minute, the velocity being measured midway between the outer surface of the drum and the adjacent vertical inner wall of the vessel.

Next, a small shell and tube type heat exchanger was installed into the delivery line adjacent to the bottom of the coating vessel and at the entrance to the manifold. A drum was dipped into the coating vessel as described above. The resultant coating was free of streaks, which demonstrated that the presence of the heat exchanger in the line, in and of itself, did not cause streaks in the coating. Next, the pump speed which had been set to effect a 27 millimeters/minute flow rate upwardly in the coating vessel was varied to produce higher recirculation rates throughout the system as described above. The pump was adjusted to produce a 35 millimeters/minute flow rate upwardly in the coating vessel. A drum was dipped into the coating vessel as described above. The resultant coating was covered with streaks, which demonstrated that the appearance of streaks was not only related to obstructions in the line per se but also related to the rate of flow through and around those obstructions. Since flow rate is here directly proportional to shear rate the non offensive heat exchanger suddenly caused defects as the flow through it is increased from the minimal desired level.

EXAMPLE VII

The experimental procedures described in paragraphs 1, 2, and 3, from Examples V & VI above were repeated except that a device was added to the bottom of the coating vessel as described in Examples V & VI above. This device is depicted in FIGS. 6, 7, & 8. This device is herein referred to as a "Vortex Breaker". This device, as employed in this experiment, has the effect of introducing a cross shaped set of blades 1 millimeter wide into the opening at the bottom of the coating vessel, which are parallel to the direction of flow of the solution. Also the entrance to the bottom of the coating vessel was restricted from the 35 millimeter diameter delivery tube, down to a ten millimeter diameter. Additionally the bottom angle of the coating vessel cone was adjusted by this device to a 45 degree intercept with the coating vessel walls. This device was held in place by two O-rings of TEFLON encapsulated rubber, which also served to restrict the flow of solution solely to flowing through the cross shaped blade opening. This device was machined from stainless steel, but might alternately be fabricated from Teflon, nylon, aluminum or other suitable materials. All conditions of the system were set, before the addition of the "Vortex Breaker," as previously noted, so as to produce a coating surface on the drum which was free of all defects. A drum was then dipped into the coating vessel as described above with the "Vortex Breaker" in place in the coating vessel. This coating was completely covered with multiple streaks. This experiment demonstrated two major parameters which affect the coating surface quality. First, the liquid coating material will not tolerate a sudden change in velocity as the device had the effect of causing the coating material to undergo a sudden increase in velocity as it passed through the smaller opening provided by the device, and then alternately experiencing a sudden decrease in velocity as it opens into the bottom of the coating vessel. The coating material experiences these sudden velocity changes as shear factors. The coating on the drum then shows multiple streaks. Secondly, the coating material will not tolerate an obstruction in the flow path such as is provided by the cross shaped blades in the "Vortex Breaker". These obstructions also cause a sudden change in velocity as the coating material has to change velocity and direction as it flows around the obstruction. The liquid coating material "sees" these changes as a sudden increase in shear factors and then the coating on the drum then exhibits multiple streak defects.

EXAMPLE VIII

The experimental procedures described in paragraphs 1, 2, and 3, from Examples V, VI and VII above were repeated except that a device was added to the bottom of the coating vessel at the end of the elbow manifold where it would normally connect to the delivery line for the solution. This device was a normal ball valve that would be typically found in a fluid delivery system and is usually employed as a shutoff device or alternately as a throttling device when used in a partially closed position. This ball valve is special only in that it was specified to have a fully open position such that when it is fully open the flow path is neither smaller nor larger than the connecting tubing, incoming or outgoing, in cross section. All conditions of the system were set before the addition of the ball valve, as previously noted, so as to produce a coating surface on the drum which was free of all defects. A drum was then dipped into the coating vessel as described above with the ball valve in place in the coating vessel. This coating was completely free of defects. This result showed that the "ball valve" in and of itself did not introduce any effects to cause defects in the coated surface. A drum was then dipped into the coating vessel as described above with the ball valve in place below the coating vessel, and the valve set to a partially closed position, which represented a 75 percent restriction to the normal flow. A drum was then dipped into the coating vessel as described above with the ball valve in place in the coating vessel. This coating on the drum was completely covered with multiple streaks. This experiment demonstrated that the obstruction provided by the restriction of the partially closed valve was quite sufficient to induce the necessary shear to cause the coating material to demonstrate streaking which causes the defect in the drum coating and subsequently on the copy made from the coated drum.

EXAMPLE IX

The experimental procedures described in paragraphs 1, 2, and 3, from Examples V, VI, VII and VIII above were repeated except that a device was added to the bottom of the coating vessel at the end of the elbow manifold where it would normally connect to the delivery line for the liquid coating material. This device was a series of right angle "T's" as would normally be employed in a plumbing or hydraulic system to effect a change of direction. Also a series of right angles or "T's" would normally be employed in a system to construct a "bypass", which would allow an alternate path for a liquid coating material in order to accomplish a repair or to replace an active device in the system. Just such a device, consisting of a series of four right angles or "T's" was added to the manifold at the bottom of the coating vessel where the solution delivery tube would normally connect. The solution delivery tube was then connected to this device. All conditions of the system were set before the addition of the "bypass" as previously noted so as to produce a coating surface on the drum which was free of all defects. A drum was then dipped into the coating vessel as described above with the "bypass" in place in the coating vessel and the coating material flowing through it. The deposited coating on this drum was completely covered with multiple streaks. This experiment demonstrated that the liquid coating material reflected the sudden changes in direction induced by the "bypass" device by producing coatings on the drums which were covered with the streak defects.

EXAMPLE X

The experimental procedures described in paragraphs 1, 2, and 3, from Examples V, VI, VII, VIII and IX above except that all the additional devices of all the previous experiments were removed from the system. All conditions of the coating system were set, as previously noted, so as to produce a coating surface on the drum which was free of all defects. Thus, the dip coating system was configured as much as was possible to deliver a coated drum that was free of all streaks or defects. Several drums were dipped and examined and were found to be free of all defects.

Next, four obstructions were created around the perimeter of the top of the coating vessel to obstruct the normally smooth flow of solution over the edge of the coating vessel. These obstructions consisted of four pieces of aluminum foil folded over the edge so as to provide small dams at four equally spaced locations around the edge. Each dam being one inch wide. When drums were subsequently dip coated in this coating vessel, the coated surfaces showed streak defects which were located on the surface of the drum and directly opposite and reflecting the position of the dams. The dams were removed one at a time and drums were coated from each subsequent configuration. At every instance the streak defects reflected the position of the remaining dams. The streak formation was also found to be independent of pump speed or coating vessel velocity. The defect always existed on the coating when there was a dam or a nonuniform flow at the surface. These were termed, "Positional Streaks". The relative intensity of the "Positional Streaks" was related to pump velocity or surface flow velocity, but they always are seen to exist when there is a discontinuity of flow at the surface. Therefore the coating vessel top surface must always be smooth, level, and uniform. Also the incoming flow of solution must be smooth and laminar so as to provide a uniform overflow.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for dip coating drums comprising providing a drum having an outer surface to be coated, an upper end, a lower end and an axis, providing at least one coating vessel having a bottom, an open top and a cylindrically shaped vertical interior wall having a diameter greater than the diameter of the drum, flowing liquid coating material under laminar flow motion from the bottom of the vessel to the top of the vessel, immersing the drum in the flowing liquid coating material while positioning the axis of the drum in a vertical orientation, positioning the outer surface of the drum in a concentric relationship with the vertical interior wall of the coating vessel while the drum is immersed in the coating material, the outer surface of the drum being radially spaced between about 2 millimeters and about 9 millimeters from the vertical interior wall of the coating vessel, maintaining the laminar flow motion of the flowing coating material as it passes between the outer surface of the drum and the vertical interior wall of the vessel, and withdrawing the drum from the coating vessel.

2. A process according to claim 1 wherein the radial spacing is between about 4.5 millimeters and about 8.5 millimeters.

3. A process according to claim 2 wherein the radial spacing is between about 5.5 millimeters and about 7.5 millimeters.

4. A process according to claim 1 wherein the flowing liquid coating material comprises pigment particles dispersed in a solution of a film forming polymer dissolved in a solvent.

5. A process according to claim 4 wherein the flowing liquid coating material comprises between about 2 percent and about 12 percent by weight of the pigment particles and the film forming polymer based on the total weight of the liquid coating material.

6. A process according to claim 5 wherein the pigment particles have an average particle size of less than about 1 micrometer.

7. A process according to claim 6 wherein the pigment particles have an average particle size of between about 0.05 micrometer and about 0.2 micrometer.

8. A process according to claim 4 wherein the flowing liquid coating material has a viscosity of between about 1 centipoise and about 100 centipoises.

9. A process according to claim 8 wherein the flowing liquid coating material has a viscosity of between about 2 centipoises and about 10 centipoises.

10. A process according to claim 1 including maintaining the flow of the flowing coating material as it passes between the outer surface of the drum and the vertical interior wall of the vessel at between about 15 millimeters per minute and about 300 millimeters per minute, the velocity being measured midway between the outer surface of the drum and the vertical interior wall of the vessel.

11. A process according to claim 1 including flowing the flowing liquid coating material under laminar flow motion through a passageway which feeds the flowing liquid coating material into the bottom of the vessel.

12. A process according to claim 11 including maintaining the laminar flow motion of the flowing liquid coating material into the bottom of the vessel and around the lower end of the drum.

13. A process according to claim 11 including flowing the flowing liquid coating material through at least one bend in the passageway, the bend having a radius of curvature of at least about 5 centimeters.

14. A process according to claim 11 including pumping the flowing liquid coating material from a reservoir through a filter to the passageway, the filter imparting a pressure drop in the coating material of less than about 140 grams/square centimeter.

15. A process according to claim 14 including pumping the flowing liquid coating material from the reservoir through a filter to the passageway, the filter imparting a pressure drop in the flowing coating material of less than about 70 grams/square centimeter.

16. A process according to claim 11 including pumping the flowing liquid coating material from a reservoir to the passageway while maintaining any variation in temperature of the coating material to a total of less than about 2° C.

17. A process according to claim 16 including pumping the flowing liquid coating material from the reservoir to the passageway while maintaining any variation in temperature of the liquid coating material to a total of less than about 0.5° C.

18. A process according to claim 11 including maintaining the laminar flow motion of the flowing liquid coating material into the bottom of the vessel and around the bottom end of the drum by flowing the flowing liquid coating material through a funnel shaped chamber at the bottom of the coating vessel.

19. A process according to claim 1 including flowing the flowing liquid coating material over the top of a weir located at the top of the vessel.

20. A process according to claim 19 wherein the weir has the same inside diameter as the diameter of the cylindrically shaped vertical interior wall of the coating vessel.

21. A process according to claim 20 wherein the weir has a radial thickness of less than about 2 millimeters.

22. A process according to claim 19 including providing a plurality of the coating vessels wherein each of the vessels has a weir located at the top of the vessels, the weir having a top, and the top of the weir of each of the vessels is aligned to be in the same imaginary horizontal plane.

23. A process for dip coating drums comprising providing a plurality of drums, each of the drums having an outer surface to be coated, an upper end, a lower end and an axis, providing at plurality of coating vessels for each of the drums, each of the vessels having a bottom, an open top and a cylindrically shaped vertical interior wall having a diameter greater than the diameter of a drum, flowing liquid coating material under laminar flow motion from the bottom of each vessel to the top of the vessel, immersing each drum in the flowing liquid coating material while positioning the axis of each drum in a vertical orientation, positioning the outer surface of each drum in a concentric relationship with the vertical interior wall of the coating vessel while the drum is immersed in the coating material, the outer surface of the drum being radially spaced between about 2 millimeters and about 9 millimeters from the vertical interior wall of the cylindrical coating vessel in which the drum is immersed, maintaining the laminar flow motion of the flowing coating material as it passes between the outer surface of each drum and the vertical interior wall of the vessel in which the drum is immersed, flowing the flowing liquid coating material under laminar flow motion through a manifold and a plurality of passageways, each of the passageways feeding the flowing liquid coating material from the manifold into the bottom of a coating vessel, and withdrawing the drum from the coating vessel.

24. A process according to claim 23 wherein the cross-sectional area of the manifold is substantially equal to the sum of the cross-sectional areas of each of the passageways between the manifold and the bottom of each coating vessel.

* * * * *